US005764778A

United States Patent [19]

Zurek

[11] Patent Number: 5,764,778

[45] Date of Patent: Jun. 9, 1998

[54] HEARING AID HEADSET HAVING AN ARRAY OF MICROPHONES

[75] Inventor: Patrick M. Zurek, Arlington, Mass.

[73] Assignee: Sensimetrics Corporation, Cambridge, Mass.

[21] Appl. No.: 486,892

[22] Filed: Jun. 7, 1995

[51] Int. Cl.[6] ..... H04R 25/00

[52] U.S. Cl. ..... 381/68; 381/681; 381/183; 381/187

[58] Field of Search ..... 381/68, 68.1, 68.2, 381/68.3, 72, 71, 95, 99, 183, 187, 25, 26, 68.4, 69, 168, 169, 92, 17–24; 367/119–127; 379/430

[56] References Cited

U.S. PATENT DOCUMENTS

| | | | |
|---|---|---|---|
| 3,306,991 | 2/1967 | Wood | 381/72 |
| 3,683,130 | 8/1972 | Kahn | 381/72 |
| 4,088,849 | 5/1978 | Usami et al. | 381/25 |
| 4,096,353 | 6/1978 | Bauer | 381/21 |
| 4,425,281 | 1/1984 | Mansgold | 381/68 |
| 4,773,095 | 9/1988 | Zwicker et al. | 381/68.1 |
| 4,837,832 | 6/1989 | Fanshel | 381/71 |
| 4,904,078 | 2/1990 | Gorike | 351/158 |
| 4,910,779 | 3/1990 | Cooper et al. | 381/1 |
| 5,029,216 | 7/1991 | Jhabvala et al. | 381/68.1 |
| 5,125,032 | 6/1992 | Meister et al. | 381/183 |
| 5,173,944 | 12/1992 | Begault | 381/24 |
| 5,239,588 | 8/1993 | Davis | 381/68 |
| 5,265,168 | 11/1993 | Schiess et al. | 381/69 |
| 5,390,254 | 2/1995 | Adelman | 381/68 |
| 5,666,425 | 9/1997 | Sibbald et al. | 381/24 |

OTHER PUBLICATIONS

Soede et. al. "Development of a directional hearing instrument based on array technology", J. Acoust. Soc. Am. 94(2), Pt. 1, Aug. 1993.

Soede et. al. "Assessment of a directional microphone array for hearing–impaired listeners", J. Acoust. Soc. Am. 94(2), Pt. 1, Aug. 1993.

Desloge, Joseph Gilles, "Fixed–Filter Multimicrophone Hearing Aids with Binaural Output," Sep. 1994, Massachusetts NIH Abstracts from 1991, 1994, and 1995.

*Primary Examiner*—Curtis A. Kuntz
*Assistant Examiner*—Rexford Barnie
*Attorney, Agent, or Firm*—Hale and Dorr LLP

[57] ABSTRACT

A hearing aid has a plurality of microphones mounted in an array on a headband which extends from one ear over the top of the head to the other ear. The headband is flexible and adjustable in length. The headband has circuitry that can be switched among a directional monaural mode, a binaural mode, and a combination mode that provides both directionality and binaurally. Ganged controls are provided on the headband for both tone and volume. An external jack is provided on the headband to allow for the introduction of radio or recorded music from a personal stereo.

22 Claims, 2 Drawing Sheets

HEARING AID HEADSET HAVING AN ARRAY OF MICROPHONES

STATEMENT OF RIGHTS TO INVENTION UNDER FEDERALLY FUNDED RESEARCH

The United States government may have rights to this invention under grant no. R44 DC01299-03 from the National Institutes of Health.

FIELD OF THE INVENTION

This invention relates to hearing aids.

BACKGROUND OF THE INVENTION

Hearing aids have generally been packaged in three basic styles: body aids, eyeglass aids, and ear-level aids.

Body aids, the earliest portable electronic hearing aids, typically consisted of a container holding a microphone and an amplifier. The container was worn in the wearer's shirt pocket or strapped to the wearer's chest, and was coupled to receivers in the ears.

With miniaturization, hearing aids became sufficiently small and lightweight to be worn entirely on the head. In some devices, microphones were provided on the temples of eyeglasses, thus combining two prosthetic devices in one. Such eyeglass aids are shown, for example, in U.S. Pat. Nos. 4,904,078 and 4,773,095.

Ear-level aids, the smallest of the three styles, are worn on or in the ear. These aids come in behind-the-ear, in-the-ear, and in-the-canal styles, in order of decreasing size.

Manufacturers of hearing aids currently emphasize the smaller-sized ear-level styles so that the wearer avoids the supposed stigma of wearing a hearing aid. Many of these current ear-level hearing aids require custom earmolds that can be uncomfortable and that add to the expense of the hearing aid. Making a hearing aid as small as possible can also lead to a compromise of sound quality.

SUMMARY OF THE INVENTION

The present invention is a hearing aid that has an array of microphones mounted on a headband that extends across, and preferably over, the wearer's head. Each microphone in the array is preferably a directional microphone with maximal sensitivity to sounds straight ahead of the wearer. While the array may have as few as two microphones, or any larger number that will fit on the device, the array preferably has more than two microphones, and more preferably has four microphones.

The hearing aid preferably can be switched to one of three different modes: (1) a directional, monaural mode that uses signals from all the microphones in the array to enhance sound sources in front of the listener; (2) a binaural mode in which microphones at the ends of the array provide signals directly to the closer ear; and (3) a combination mode in which directional and binaural features are combined through signal processing.

The signals from the microphones are provided to circuitry that processes the signals. The resulting processed signals are provided to earpieces, preferably insert earphones with removable foam tips. The switching between monaural, binaural, and combination modes is preferably performed by changing a filtering cutoff frequency, although it may also be carried out by some combination of such filtering and altering the connections of various microphones to the amplifiers used.

The hearing aid has an external jack on the headband to allow the output of a personal stereo or other audio source to be connected directly to the amplifier circuitry.

The hearing aid of the present invention has a number of advantages over other types of hearing aids. The microphone array can provide enhancement of straight-ahead signals relative to signals from other directions. This signal enhancement may result from simple filtering and summation of the microphone signals, or from more sophisticated processing that adapts the device to changes in the acoustic environment, e.g., through cancellation of some sounds.

By using an array mounted on the headband of a headset, the array can have a somewhat greater linear span—resulting in greater directionality—than can be achieved by other configurations, such as eyeglasses. Moreover, because of the curvature of the array on top of the head, directionality can be achieved in both the vertical direction and the horizontal direction.

The headset hearing aid has other important advantages. It has more space for signal-processing circuitry than other typical hearing aids do. The controls on the headset hearing aid can be made larger and therefore easier to use than those on ear-level aids. Because of the placement of the headset on top of the head, the aid allows the user to carry a larger, heavier battery than could be tolerated with an ear-level or eyeglass-style hearing aid.

The foam insert tips provide a coupling to the ear that is both comfortable and less costly than custom earmolds. The use of simple foam tips also makes the headset hearing aid easy to put on and remove.

For those users who wish to hide the use of a hearing aid, headset hearing aids can be camouflaged as an entertainment device.

The hearing aid is preferably designed to facilitate electroacoustic adjustment by the dispenser, thus reducing the time and expense required for adjustment compared to the dispensing of miniature aids. Other features and advantages will become apparent from the following detailed description and from the claims.

DETAILED DESCRIPTION

Figure 1:
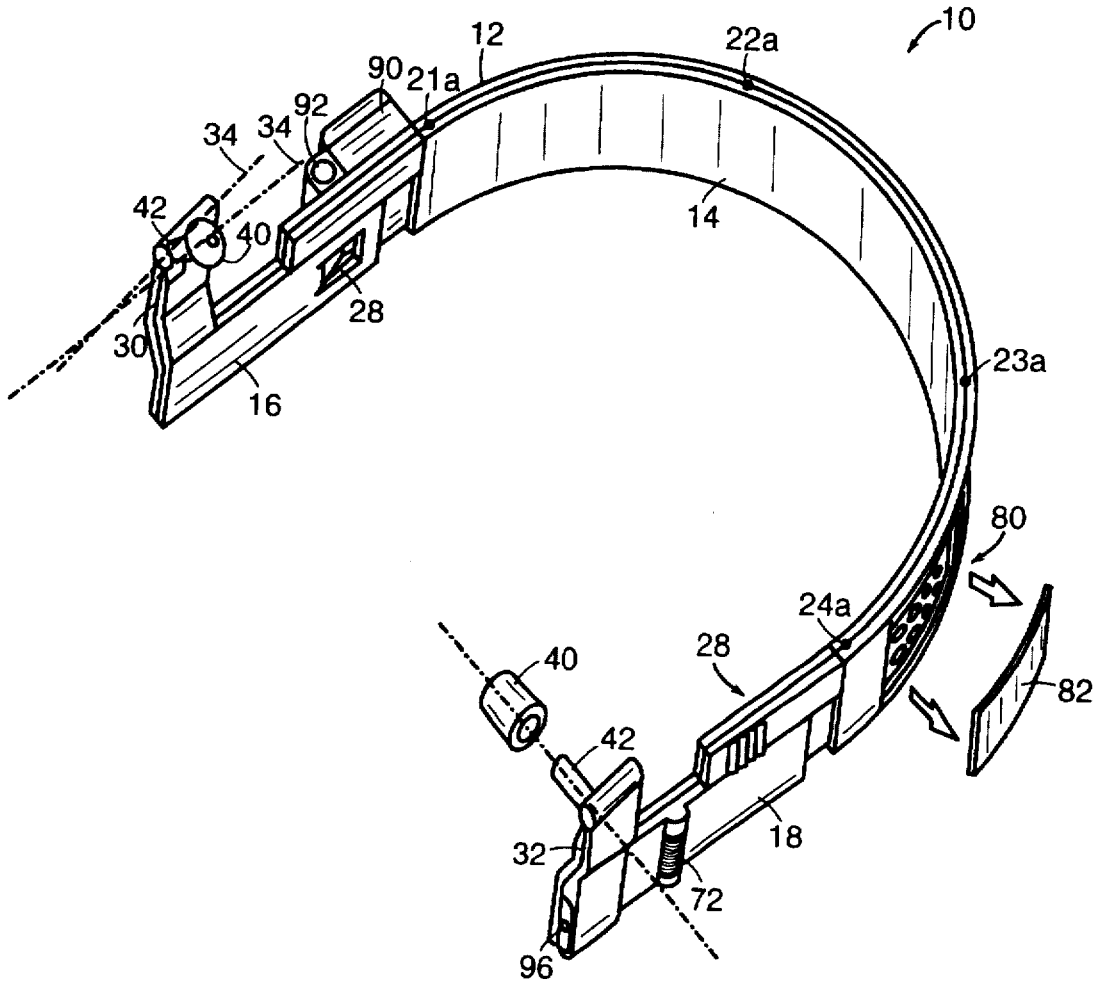
FIG. 1 is a rear perspective view of a hearing aid according to the present invention.

Referring to the rear perspective view of FIG. 1, a headset hearing aid 10 has a housing 12 shaped as a band that extends over the top of a wearer's head. The housing includes a slightly flexible, inverted U-shaped band 14 and end members 16, 18 at each end. Mounted on band 14 is an array of microphones, preferably four matched directional microphones. Such directional microphones operate by combining acoustic signals from at least two closely-spaced locations. These acoustic signals can be sensed either by separate transducer elements, or by a single transducer element fed by multiple acoustic ports. (Hereafter, the term "elements" is used for either elements or ports.) The directional microphones in FIG. 1 each have two elements. Only the rear elements 21*a*, 22*a*, and 24*a* are shown in FIG. 1, but the hearing aid would also have four more microphone elements, each paired with one of elements 21*a*, 22*a*, and 24*a*. These elements form four directional microphones 21–24, which make up array 25.

The preferred array has two end microphones 21, 24, and two intermediate microphones 22, 23. The microphones may, but need not be, equally spaced apart. The end microphones are each positioned an equal distance, preferably about 8 cm, from the entrances to respective ear canals. Because of the curvature of the band, intermediate microphones 22, 23 are spaced both vertically and horizontally from end microphones 21, 24.

Each end member 16, 18 of the headband has an adjustable coupling 28 that allows the individual user to adjust the overall length of the respective end member for comfort. The coupling 28 can have an interference fit slide, a ratchet arrangement, or any other means for adjusting the length. Such an adjustment changes slightly the distance between end microphones and the ear canals.

At the ends of end members 16, 18 are earpiece assemblies 30, 32 that are mounted obliquely relative to band 14 (as indicated by dashed lines 34), and are, to a limited degree, pivotally movable relative to the band. To provide comfort and to reduce fitting costs, the ear piece assemblies include foam tips 40, such as "COMPLY" Canal Tips (a trademark of Hearing Components, Inc.), rather than custom-fitted ear molds. Foam tips 40 have internal tubes that are threaded at an outer end for coupling to earphones 42. Each earphone, in turn, has a small receiver (such as a Knowles ED1932) and has a threaded protrusion for accepting foam tip 40. These foam tips are comfortable, provide good occlusion, and come in several different sizes and degrees of venting.

Figure 2:
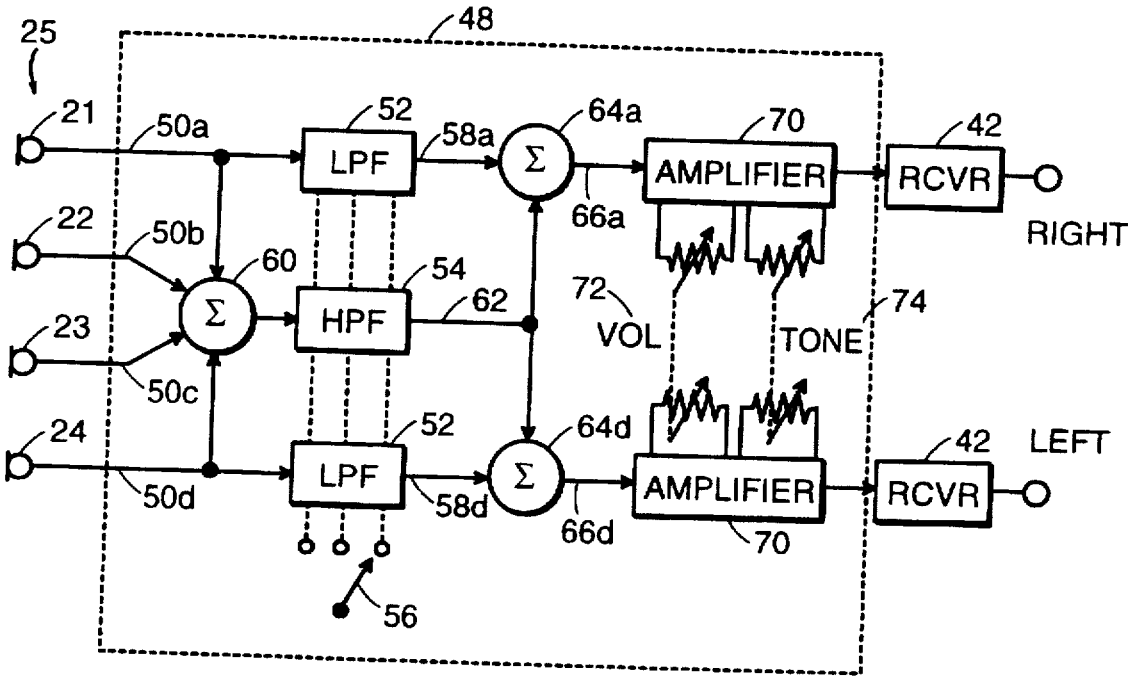
FIG. 2 is a block schematic of a circuit used with the hearing aid of FIG. 1.

Referring to FIG. 2, microphones 21–24 of array 25 provide signals to circuitry 48 that is mounted on the headband. Circuitry 48 provides processed output signals to left and right earphones 42. A switch 56 (not shown in FIG. 1) allows a user to select among three modes of operation: (1) a directional mode, in which the signals from all microphones are combined into one signal that is output to either or both earphones; (2) a binaural mode, in which left and right end microphone signals are separately processed and presented to respective left and right earphones 42 with no contribution from signals from intermediate microphones; and (3) a combination mode in which the spectrum is divided at a cutoff frequency, $f_c$, with signals in the frequency region below $f_c$ processed as in the binaural mode and signals above $f_c$ processed as in the directional mode. The directional mode is preferred for continual, focused listening to a straight-ahead source, e.g., one-on-one conversation or television viewing; the binaural mode is preferred for situations in which a straightahead focus is not required or desired, e.g., talking in a car; and the combination mode is a compromise that provides both directionality and binaurality.

End microphones 21 and 24 provide signals 50*a*, 50*d* to lowpass filters (LPF's) 52 to produce filtered signals 58*a*, 58*d*. Signals 50*a* , 50*d* are also combined in a summing circuit 60 with signals 50*b*, 50*c* provided by intermediate elements 22, 23. The summed signal is provided to a highpass filter (HPF) 54.

Switching among the listening modes via switch 56 can be accomplished by controlling cutoff frequency $f_c$ of HPF 54 and LPF's 52. In the directional mode, the cutoff frequency is set to a very low frequency (e.g., <50 Hz), so that effectively all of the audio signal is passed by the HPF and none by the LPF's. In this mode, the headset provides good directionality because of the horizontal and vertical displacement of the microphones, and because of the wide span of the microphones over the head.

In the binaural mode, the switch causes the cutoff frequency to be raised to a frequency near or beyond the upper limit of the range of human hearing (i.e., about 20,000 Hz), so that HPF 54 passes no audible signals, while LPF's 52 pass the entire audio spectrum. Thus, in the binaural mode, intermediate elements 22, 23 are effectively disabled, while signals from end elements 21, 24 are effectively passed unfiltered.

In the combination mode the cutoff frequency is about 1000 Hz and signal 62 from HPF 54 is combined in summing circuits 64*a*, 64*d* with respective filtered signals 58*a*, 58*d* to produce signals 66*a*, 66*d*. This mode provides a good compromise between the directional and binaural modes.

In any of the three modes, signals 66*a*, 66*d* are each provided to an amplifier 70, which provides amplified signals to the left and right receiving earphones 42. In general, a high quality flexible amplifier that is capable of providing equalization, amplification, and compression is desired. An example of one such amplifier is the "K-AMP" (a trademark of Etymotic Research), which was developed to specifically address the amplification needs of the vast majority of hearing aid wearers. Specifically, these amplifiers provide high-frequency gain at low sound levels, with the gain decreasing as sound level increases. At high sound levels, the aid has approximately unity-gain, assuming the volume control is adjusted appropriately. See Killion, "The K-AMP Hearing Aid: An attempt to present high-fidelity for persons with impaired hearing", Am. J. Audiol. 2, pp. 52–74(1993).

The hearing aid has a volume control 72 and tone control 74, each of which is ganged to control potentiometers in the amplifiers 70 of both the right and left channels with a single control. As shown in FIG. 1, these controls (only volume control 72 is shown) can be provided as rollers on the band for easy variable adjustment.

Referring again to FIG. 1, dispenser controls 80, which are adjusted by the hearing aid dispenser, are mounted so that they are easily accessible to the dispenser behind an easily removable snap-in panel 82. Controls 80 allow simple screwdriver adjustments that are made individually for the particular patient based on his/her audiometric needs, and include typical dispenser's adjustments, such as a kneepoint of compression for controlling the amount of low-level gain, and a low-frequency cutoff for controlling how the frequency response changes with sound level. These controls, which are mounted on band 14, also include a switch for changing the compressor to be frequency-independent.

Mounted on end member 16 is a battery housing 90 with a recharging jack 92. The battery is preferably a Sanyo N-110AA or similar model.

At the end of end member 18 is an external jack 96 that can be used to accept direct audio input from a personal stereo or other such device. By plugging in an adapter, the signals from the external device are provided to circuitry 48. Another switch (not shown) allows the user to select whether the microphone array 25 continues to process external sound, mixed with the signal from the external device. The headband thus can serve a dual role for the wearer.

Measurements on a KEMAR mannequin have confirmed that a design according to the present invention can provide sufficient gain to be appropriate for hearing losses as large as those in the severe category.

Having described an embodiment of the present invention, it should be apparent that changes and modifications can be made without departing from the scope of the appended claims. For example, while FIG. 1 shows a band that is thin and wide, the band could take other shapes; it could be narrower in width and thicker. To make the band more attractive, other design modifications can be made, such as providing braided fabric over the band. The circuitry has been described as analog, but it could be digital by providing an A/D converter coupled to the microphones, digital filters, digital amplifiers, and a D/A converter for providing signals to the earphones. The circuitry can also be made adaptive, e.g., to cancel out an interference source, or to cause the listening modes to be switched automatically based on the received sounds.

What is claimed is:

1. A hearing aid to be worn by a user, the hearing aid including:

a band that is sized and shaped to extend from one ear up and over the top of the user's head to the other ear, the band being adjustable in length and flexible;

at least three microphones mounted on the band, at least one of the microphones being between the one ear and the other ear and over the head of the user, thereby providing vertical and horizontal directionality when the band is worn by the user;

circuitry mounted on the band for receiving acoustic signals from the plurality of microphones and for providing amplified acoustic signals; and first and second earphones mounted at opposite ends of the band for presenting the amplified acoustic signals to the user.

2. The hearing aid of claim 1, wherein the earpieces are non-custom fitted foam tips.

3. The hearing aid of claim 1, wherein the number of microphones is four, with first and second microphones at first and second ends of the band near the respective first and second earphones, and third and fourth microphones over the head at intermediate positions between the first and second microphones at the same vertical height relative to the user.

4. The hearing aid of claim 1, wherein the band has means for manually adjusting the volume of the amplified signals.

5. The hearing aid of claim 1, wherein the band has end members with means for adjusting a length of the band, the ear pieces being coupled to the end members.

6. The hearing aid of claim 1, further including dispenser controls mounted on the band, and a removable access panel over the dispenser controls.

7. The hearing aid of claim 1, wherein the band has a switch for switching the hearing aid among a binaural mode, a directional mode, and a mode that combines directionality and binaurally.

8. The hearing aid of claim 7, wherein the circuitry includes at least one highpass filter and at least one lowpass filter, wherein the switch adjusts a filtering frequency.

9. The hearing aid of claim 1, wherein the band has means for manually adjusting the tone of the amplified signals.

10. A hearing aid to be worn by a user and including:

a band that is sized and shaped to extend from one ear up and over the user's head to the other ear;

at least three microphones mounted on the band in an array for picking up sounds, the microphones being mounted to provide both horizontal and vertical directionality when the band is worn; and ear pieces for receiving signals derived from the sounds picked up by the microphones.

11. The hearing aid of claim 10, further including circuitry for receiving signals from the microphones and for filtering and amplifying the received signals.

12. The hearing aid of claim 11, further including means for controlling the tone of the filtered, amplified signals.

13. The hearing aid of claim 12, further including means for controlling the volume of the filtered, amplified signals.

14. The hearing aid of claim 10, wherein the band has adjustable length end members, wherein the ear pieces are mounted on the end members.

15. The hearing aid of claim 10, wherein the plurality of microphones are directional microphones and include two end microphones and a plurality of intermediate microphones, the end microphones being closest to the ear pieces.

16. The hearing aid of claim 15, wherein signals from the end microphones are provided to lowpass filters, and a linearly-filtered combination of the signals from all of the microphones is provided to a highpass filter.

17. The hearing aid of claim 16, further including a switch for switching a frequency for filtering in the lowpass and highpass filters.

18. The hearing aid of claim 17, wherein the switch switches from about 50 Hz for a first mode, about 1000 Hz for a second mode, and about 20,000 Hz for a third mode.

19. The hearing aid of claim 10, wherein at least some of the circuitry is digital.

20. The hearing aid of claim 10, further comprising a jack for receiving external audio signals and for providing the external audio signals to the circuitry.

21. A hearing aid to be worn by a user, the hearing aid including:

a band that is sized and shaped to extend from a first end portion up and over the top of the user's head to a second end portion, the band being adjustable in length and flexible;

at least three microphones mounted on the band, at least one of the microphones being between the first end portion and the second end portion such that the microphones provide directionality along two orthogonal axes;

circuitry mounted on the band for receiving acoustic signals from the plurality of microphones and for providing amplified acoustic signals; and first and second earphones mounted at respective first and second ends of the band for presenting the amplified acoustic signals to the user.

22. The hearing aid of claim 21, wherein the number of microphones is four, with first and second microphones at first and second ends of the band near the respective first and second earphones, and third and fourth microphones over the head at intermediate positions between the first and second microphones at the same vertical height relative to the user.

* * * * *